US010683825B1

(12) United States Patent
Perry et al.

(10) Patent No.: US 10,683,825 B1
(45) Date of Patent: Jun. 16, 2020

(54) FUEL PUMP AND INLET VALVE ASSEMBLY THEREOF

(71) Applicant: DELPHI TECHNOLOGIES IP LIMITED, St. Michael (BB)

(72) Inventors: Robert B. Perry, Leicester, NY (US); Jason C. Short, Webster, NY (US); Youssef Kazour, Pittsford, NY (US)

(73) Assignee: DELPHI TECHNOLOGIES IP LIMITED (BB)

( * ) Notice: Subject to any disclaimer, the term of this patent is extended or adjusted under 35 U.S.C. 154(b) by 0 days.

(21) Appl. No.: 16/208,717

(22) Filed: Dec. 4, 2018

(51) Int. Cl.

| | |
|---|---|
| ***F04B 49/22*** | (2006.01) |
| ***F02M 59/18*** | (2006.01) |
| ***F02D 41/38*** | (2006.01) |
| ***F02M 59/36*** | (2006.01) |
| ***F04B 35/00*** | (2006.01) |
| ***F04B 49/06*** | (2006.01) |
| ***F02M 63/00*** | (2006.01) |

(52) U.S. Cl.
CPC ..... *F02D 41/3845* (2013.01); *F02M 59/367* (2013.01); *F02M 63/0021* (2013.01); *F02M 63/0054* (2013.01); *F04B 35/002* (2013.01); *F04B 49/065* (2013.01); *F04B 49/225* (2013.01); *F04B 2201/0604* (2013.01); *F04B 2203/0605* (2013.01)

(58) Field of Classification Search
CPC ..... F02D 41/3845; F02M 59/367; F02M 59/368; F02M 59/464; F02M 59/466; F02M 63/0021; F02M 63/0022; F02M 63/0024; F02M 63/0033; F02M 63/0054; F02M 63/0056; F02M 63/0075; F04D 49/225; F04D 49/243
See application file for complete search history.

(56) References Cited

U.S. PATENT DOCUMENTS

| | | | | |
|---|---|---|---|---|
| 3,665,907 | A * | 5/1972 | Laufer | F02D 1/18 123/454 |
| 6,631,706 | B1 * | 10/2003 | Yamada | F02M 59/442 123/447 |
| 7,401,594 | B2 | 7/2008 | Usui et al. | |
| 7,707,996 | B2 | 5/2010 | Yamada et al. | |
| 10,443,555 | B2 * | 10/2019 | Schmitz | F02M 59/367 |
| 2002/0129793 | A1 * | 9/2002 | Tokuo | F02D 41/38 123/457 |
| 2003/0059322 | A1 * | 3/2003 | Hiraku | F02M 59/368 417/505 |

(Continued)

*Primary Examiner* — Thomas N Moulis
(74) *Attorney, Agent, or Firm* — Joshua M. Haines

(57) ABSTRACT

A fuel pump includes a fuel pump housing with a pumping chamber; a pumping plunger which reciprocates within a plunger bore; and an inlet valve assembly. The inlet valve assembly includes a check valve member which is moveable between an unseated position which provides fluid communication between the pumping chamber and a fuel supply passage and a seated position which prevents fluid communication between the pumping chamber and the fuel supply passage; and a solenoid assembly which includes a wire winding; a pole piece; an armature which is moveable between a first position when the wire winding is not energized and a second position when the wire winding is energized; a return spring which biases the armature away from the pole piece; and a control rod which is moveable along the inlet valve axis independently of the armature.

19 Claims, 7 Drawing Sheets

(56) References Cited

U.S. PATENT DOCUMENTS

| | | | | |
|---|---|---|---|---|
| 2006/0147317 | A1* | 7/2006 | Okamoto | F02D 41/3845 417/297 |
| 2006/0275166 | A1* | 12/2006 | Mattioli | F02M 59/102 417/571 |
| 2009/0120412 | A1* | 5/2009 | Tokuo | F02M 59/102 123/506 |
| 2012/0138021 | A1* | 6/2012 | Kim | F02M 59/368 123/495 |
| 2012/0255636 | A1* | 10/2012 | Mancini | F02M 59/366 137/565.16 |
| 2014/0070124 | A1* | 3/2014 | Kraft | F02D 41/20 251/129.04 |
| 2014/0154100 | A1* | 6/2014 | Zeng | F02M 69/02 417/53 |
| 2014/0196691 | A1* | 7/2014 | Klesse | F02D 41/20 123/480 |
| 2014/0216419 | A1* | 8/2014 | Wirkowski | F02D 41/20 123/506 |
| 2014/0217316 | A1* | 8/2014 | Zelano | F02M 63/0033 251/129.01 |
| 2014/0328708 | A1* | 11/2014 | Kasper | B01D 35/26 417/498 |
| 2015/0083948 | A1* | 3/2015 | Bleeck | F02M 63/0031 251/129.19 |
| 2015/0098848 | A1* | 4/2015 | Kato | F02M 59/367 417/437 |
| 2015/0204286 | A1* | 7/2015 | Prodi | F02M 59/368 123/499 |
| 2015/0337753 | A1* | 11/2015 | Stickler | F02M 57/02 123/506 |
| 2016/0237973 | A1 | 8/2016 | Bleeck et al. | |
| 2018/0217619 | A1* | 8/2018 | Duffy | G05D 16/2022 |
| 2018/0230955 | A1 | 8/2018 | Bleeck et al. | |

* cited by examiner

FUEL PUMP AND INLET VALVE ASSEMBLY THEREOF

TECHNICAL FIELD OF INVENTION

The present invention relates a fuel pump which supplies fuel to an internal combustion engine, and more particularly to such a fuel pump which includes an inlet valve assembly.

BACKGROUND OF INVENTION

Fuel systems in modern internal combustion engines fueled by gasoline, particularly for use in the automotive market, employ gasoline direct injection (GDi) where fuel injectors are provided which inject fuel directly into combustion chambers of the internal combustion engine. In such systems employing GDi, fuel from a fuel tank is supplied under relatively low pressure by a low-pressure fuel pump which is typically an electric fuel pump located within the fuel tank. The low-pressure fuel pump supplies the fuel to a high-pressure fuel pump which typically includes a pumping plunger which is reciprocated by a camshaft of the internal combustion engine. Reciprocation of the pumping plunger further pressurizes the fuel in order to be supplied to fuel injectors which inject the fuel directly into the combustion chambers of the internal combustion engine. During operation, the internal combustion is subject to varying demands for output torque. In order to accommodate the varying output torque demands, the mass of fuel delivered by each stroke of the pumping plunger must also be varied. One strategy to vary the delivery of fuel by the high-pressure fuel pump is to use a digital inlet valve which allows a full charge of fuel to enter the pumping chamber during each intake stroke, however, the digital inlet valve may be allowed to remain open during a portion of a compression stroke of the pumping plunger to allow some fuel to spill back toward the source. When the digital inlet valve is closed during the remainder of the compression stroke, the fuel is pressurized and the pressurized fuel is supplied to the fuel injectors. Examples of such an arrangement are disclosed in U.S. Pat. No. 7,401,594 to Usui et al. and in U.S. Pat. No. 7,707,996 to Yamada et al.

Digital inlet valves commonly include a check valve which is selectively held open during a portion of the compression stroke by a solenoid assembly to determine the fuel charge that is supplied to the fuel injectors. The solenoid assembly includes a pole piece which is stationary and an armature which is moveable based on application of an electric current to a coil. When the coil is energized with electricity, the armature is attracted to the pole piece. Conversely, when the coil is not energized, a return spring urges the armature away from the pole piece. In order to affect the state of the check valve, a control rod is rigidly fixed to the armature such that when the coil is not energized, the control rod urges the check valve to be held in an open position. Conversely, when the coil is energized, the control rod is moved to allow the check valve to open and close as a check valve normally functions based on the differential pressure across the check valve. When the coil is either energized or de-energized and the armature and control rod combination changes position, noise is generated when the combination of the armature and the control rod reaches a travel stop. Since the armature and the control rod are rigidly fixed to each other, the noise generated is a function of the total mass of the armature and the control rod and the impact velocity of the armature and control rod combination when the combination reaches the travel stop.

What is needed is a fuel pump and inlet check valve which minimizes or eliminates one or more of the shortcomings as set forth above.

SUMMARY OF THE INVENTION

Briefly described, a fuel pump includes a fuel pump housing with a pumping chamber defined therein; a pumping plunger which reciprocates within a plunger bore along a plunger bore axis such that an intake stroke of the pumping plunger increases volume of the pumping chamber and a compression stroke of the pumping plunger decreases volume of the pumping chamber; and an inlet valve assembly. The inlet valve assembly includes a check valve member which is moveable between 1) an unseated position which provides fluid communication between the pumping chamber and a fuel supply passage and 2) a seated position which prevents fluid communication between the pumping chamber and the fuel supply passage; and a solenoid assembly. The solenoid assembly includes a wire winding; a pole piece; an armature which is moveable along an inlet valve axis between 1) a first position when the wire winding is not energized with electricity and 2) a second position when the wire winding is energized with electricity; a return spring which biases the armature away from the pole piece; and a control rod which is moveable along the inlet valve axis independently of the armature. The first position of the armature urges the control rod to hold the check valve member in the unseated position and the second position of the armature allows the check valve member to move the control rod to allow the check valve member to move to the seated position. The fuel pump and inlet valve assembly as described herein minimize noise associated with operation of the inlet valve assembly by allowing the armature and the control rod to move independently of each other, thereby providing smaller, individual impacts when changing positions. Additionally, allowing the armature and the control rod to move independently of each other allows the armature to impact the pole piece with greater parallelism which helps to create a hydraulic damping effect that slows down the armature as it reaches the pole piece; thereby minimizing impact noise.

Further features and advantages of the invention will appear more clearly on a reading of the following detailed description of the preferred embodiment of the invention, which is given by way of non-limiting example only and with reference to the accompanying drawings.

BRIEF DESCRIPTION OF DRAWINGS

This invention will be further described with reference to the accompanying drawings in which.

DETAILED DESCRIPTION OF INVENTION

Figure 1:
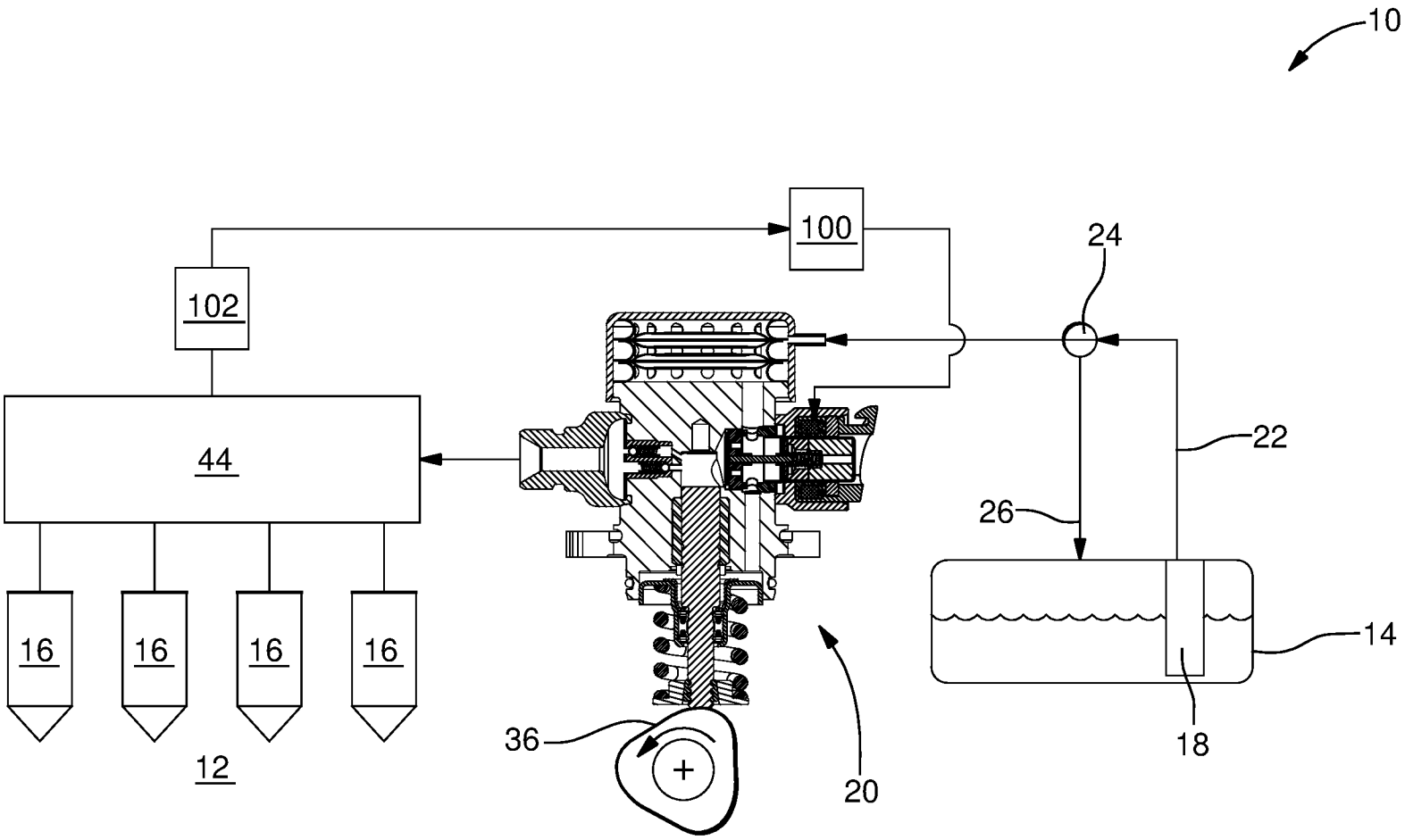
FIG. 1 is a schematic view of a fuel system including a fuel pump in accordance with the present invention.

In accordance with a preferred embodiment of this invention and referring initially to FIG. 1, a fuel system 10 for an internal combustion engine 12 is shown in schematic form. Fuel system 10 generally includes a fuel tank 14 which holds a volume of fuel to be supplied to internal combustion engine 12 for operation thereof; a plurality of fuel injectors 16 which inject fuel directly into respective combustion chambers (not shown) of internal combustion engine 12; a low-pressure fuel pump 18; and a high-pressure fuel pump 20 where the low-pressure fuel pump 18 draws fuel from fuel tank 14 and elevates the pressure of the fuel for delivery to high-pressure fuel pump 20 where the high-pressure fuel pump 20 further elevates the pressure of the fuel for delivery to fuel injectors 16. By way of non-limiting example only, low-pressure fuel pump 18 may elevate the pressure of the fuel to about 500 kPa or less and high-pressure fuel pump 20 may elevate the pressure of the fuel to above about 14 MPa and may be about 35 MPa depending on the operational needs of internal combustion engine 12. While four fuel injectors 16 have been illustrated, it should be understood that a lesser or greater number of fuel injectors 16 may be provided.

As shown, low-pressure fuel pump 18 may be provided within fuel tank 14, however low-pressure fuel pump 18 may alternatively be provided outside of fuel tank 14. Low-pressure fuel pump 18 may be an electric fuel pump as are well known to a practitioner of ordinary skill in the art. A low-pressure fuel supply passage 22 provides fluid communication from low-pressure fuel pump 18 to high-pressure fuel pump 20. A fuel pressure regulator 24 may be provided such that fuel pressure regulator 24 maintains a substantially uniform pressure within low-pressure fuel supply passage 22 by returning a portion of the fuel supplied by low-pressure fuel pump 18 to fuel tank 14 through a fuel return passage 26. While fuel pressure regulator 24 has been illustrated in low-pressure fuel supply passage 22 outside of fuel tank 14, it should be understood that fuel pressure regulator 24 may be located within fuel tank 14 and may be integrated with low-pressure fuel pump 18.

Figure 2:
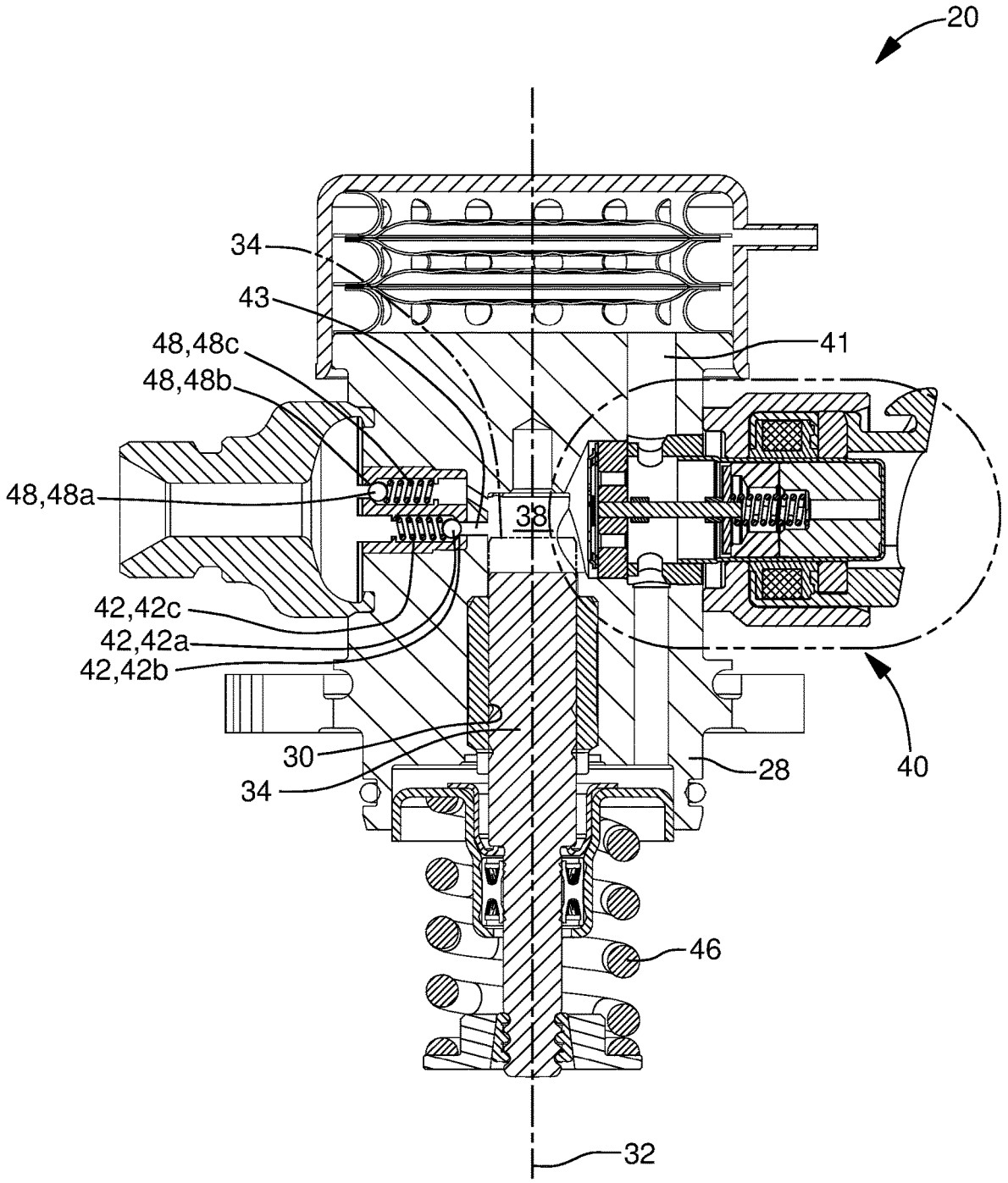
FIG. 2 is a cross-sectional view of the fuel pump of FIG. 1.
Figure 3:
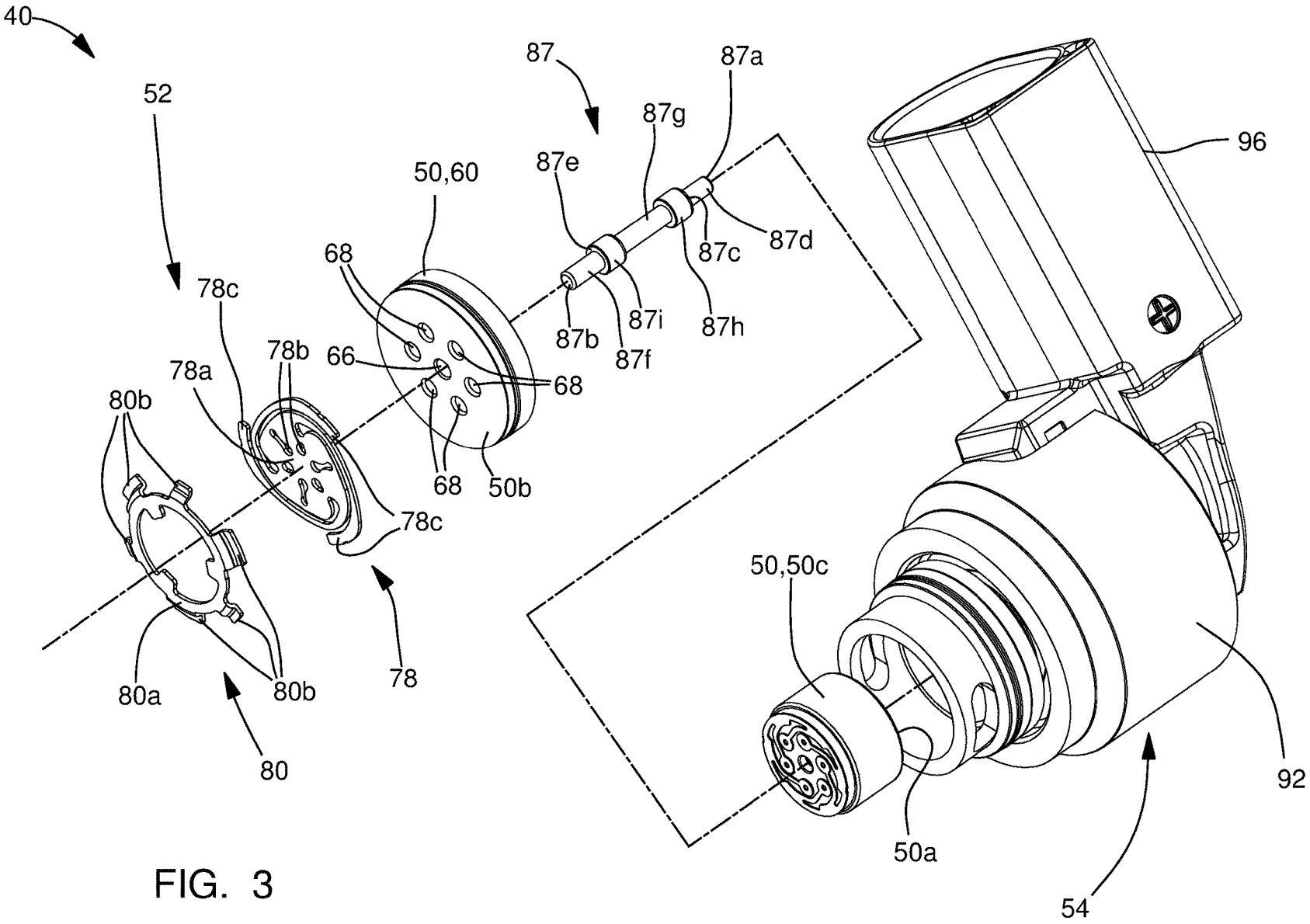
FIG. 3 is an exploded isometric view of an inlet valve assembly of the fuel pump of FIGS. 1 and 2.

Now with additional reference to FIG. 2, high-pressure fuel pump 20 includes a fuel pump housing 28 which includes a plunger bore 30 which extends along, and is centered about, a plunger bore axis 32. As shown, plunger bore 30 may be defined by a combination of an insert and directly by fuel pump housing 28. High-pressure fuel pump 20 also includes a pumping plunger 34 which is located within plunger bore 30 and reciprocates within plunger bore 30 along plunger bore axis 32 based on input from a rotating camshaft 36 of internal combustion engine 12 (shown only in FIG. 1). A pumping chamber 38 is defined within fuel pump housing 28, and more specifically, pumping chamber 38 is defined by plunger bore 30 and pumping plunger 34. An inlet valve assembly 40 of high-pressure fuel pump 20 is located within a pump housing inlet passage 41 of fuel pump housing 28 and selectively allows fuel from low-pressure fuel pump 18 to enter pumping chamber 38 while an outlet valve assembly 42 is located within an outlet passage 43 of fuel pump housing 28 and selectively allows fuel to be communicated from pumping chamber 38 to fuel injectors 16 via a fuel rail 44 to which each fuel injector 16 is in fluid communication. In operation, reciprocation of pumping plunger 34 causes the volume of pumping chamber 38 to increase during an intake stroke of pumping plunger 34 (downward as oriented in FIG. 2) in which a plunger return spring 46 causes pumping plunger 34 to move downward, and conversely, the volume of pumping chamber 38 decrease during a compression stroke (upward as oriented in FIG. 2) in which camshaft 36 causes pumping plunger 34 to move upward against the force of plunger return spring 46. In this way, fuel is drawn into pumping chamber 38 during the intake stroke, and conversely, fuel is pressurized within pumping chamber 38 by pumping plunger 34 during the compression stroke, depending on the state of operation of inlet valve assembly 40 as will be described in greater detail later, and discharged through outlet valve assembly 42 under pressure to fuel rail 44 and fuel injectors 16. For clarity, pumping plunger 34 is shown in solid lines in FIG. 2 to represent the intake stroke and pumping plunger 34 is shown in phantom lines in FIG. 2 to represent the compression stroke. High-pressure fuel pump 20 also includes a pressure relief valve assembly 48 which is arranged downstream of outlet valve assembly 42 in order to provide a fluid path back to pumping chamber 38 if the pressure downstream of outlet valve assembly 42 reaches a predetermined limit which may pose an unsafe operating condition if left unmitigated.

Outlet valve assembly 42 generally includes an outlet valve member 42*a*, an outlet valve seat 42*b*, and an outlet valve spring 42*c*. Outlet valve member 42*a*, illustrated by way of non-limiting example only as a ball, is biased toward outlet valve seat 42*b* by outlet valve spring 42*c* where outlet valve spring 42*c* is selected to allow outlet valve member 42*a* to open when a predetermined pressure differential between pumping chamber 38 and fuel rail 44 is achieved. Outlet valve assembly 42 is oriented such that fuel is allowed to flow out of pumping chamber 38 through outlet valve assembly 42, however, fuel is not allowed to flow into pumping chamber 38 through outlet valve assembly 42.

Pressure relief valve assembly 48 generally includes a pressure relief valve member 48*a*, a pressure relief valve seat 48*b*, and a pressure relief valve spring 48*c*. Pressure relief valve member 48*a*, illustrated by way of non-limiting example only as a ball, is biased toward pressure relief valve seat 48*b* by pressure relief valve spring 48*c* where pressure relief valve spring 48*c* is selected to allow pressure relief valve member 48*a* to open when a predetermined pressure differential between pumping chamber 38 and fuel rail 44 is achieved. Pressure relief valve assembly 48 is oriented such that fuel is allowed to flow into pumping chamber 38 through pressure relief valve assembly 48, however, fuel is not allowed to flow out of pumping chamber 38 through pressure relief valve assembly 48.

Inlet valve assembly 40 will now be described with continued reference to FIGS. 1 and 2 and additionally with particular reference to FIGS. 3-6. Inlet valve assembly 40 includes a valve body 50, a check valve 52, and a solenoid assembly 54. The various elements of inlet valve assembly 40 will be described in greater detail in the paragraphs that follow.

Valve body 50 is centered about, and extends along, an inlet valve axis 56 such that valve body 50 extends from a valve body first end 50*a* to a valve body second end 50*b*. A valve body bore 58 extends into valve body 50 from valve body first end 50*a* and terminates at a valve body end wall 60 which extends to valve body second end 50*b* such that valve body bore 58 is preferably cylindrical. One or more valve body inlet passages 62 extend through valve body 50 such that valve body inlet passages 62 extend from a valve body outer periphery 50*c* of valve body 50 and open into valve body bore 58. As shown, valve body 50 may be of multi-piece construction or may alternatively be formed from a single piece of material.

A valve body central passage 66 extends through valve body end wall 60 such that valve body central passage 66 connects valve body second end 50*b* with valve body bore 58 and such that valve body central passage 66 is centered about, and extends along, inlet valve axis 56. A plurality of valve body outlet passages 68 is provided in valve body end wall 60 such that each valve body outlet passage 68 extends through valve body end wall 60 and such that each valve body outlet passage 68 connects valve body second end 50*b* with valve body bore 58. Each valve body outlet passage 68 is laterally offset from valve body central passage 66 and extends through valve body end wall 60 in a direction parallel to inlet valve axis 56.

Check valve 52 includes a check valve member 78 and a travel limiter 80. Check valve 52 is arranged at valve body second end 50*b* such that check valve member 78 is moved between a seated position which blocks valve body outlet passages 68 (shown in FIG. 5) and an open position which unblocks valve body outlet passages 68 (shown in FIGS. 4 and 6) as will be described in greater detail later. Check valve member 78 includes a check valve central portion 78*a* which is a flat plate with check valve passages 78*b* extending therethrough where it is noted that only select check valve passages 78*b* have been labeled in FIG. 3 for clarity. Check valve passages 78*b* are arranged through check valve central portion 78*a* such that check valve passages 78*b* are not axially aligned with valve body outlet passages 68. A plurality of check valve legs 78*c* extend from check valve central portion 78*a* such that check valve legs 78*c* are resilient and compliant. Free ends of check valve legs 78*c* are fixed to valve body second end 50*b*, for example, by welding. Consequently, when the pressure differential between valve body bore 58 and pumping chamber 38 is sufficiently high, check valve central portion 78*a* is allowed to unseat from valve body second end 50*b* due to elastic deformation of check valve legs 78*c*, thereby opening valve body outlet passages 68. Travel limiter 80 includes a travel limiter ring 80*a* which is axially spaced apart from valve body second end 50*b* to provide the allowable amount of displacement of check valve member 78. Travel limiter 80 also includes a plurality of travel limiter legs 80*b* which provide the axial spacing between travel limiter ring 80*a* and valve body second end 50*b*. Travel limiter legs 80*b* are integrally formed with travel limiter ring 80*a* and are fixed to valve body second end 50*b*, for example by welding.

Solenoid assembly 54 includes an inner housing 82, a pole piece 84 located within inner housing 82, an armature 85 located within inner housing 82, a return spring 86 which biases armature 83 away from pole piece 84, a control rod 87, a spool 88, a coil 90, an overmold 92, and an outer housing 94. The various elements of solenoid assembly 54 will be described in greater detail in the paragraphs that follow.

Inner housing 82 is hollow and is centered about, and extends along, inlet valve axis 56. The outer periphery of inner housing 82 sealingly engages the inner periphery of valve body bore 58.

Pole piece 84 is made of a magnetically permeable material and is received within inner housing 82 in fixed relationship to inner housing 82, for example by interference fit or welding, such that pole piece 84 is centered about, and extends along, inlet valve axis 56. A pole piece first end 84*a* of pole piece 84 includes a pole piece spring pocket 84*b* extending thereinto from pole piece first end 84*a* to a pole piece spring pocket bottom surface 84*c* such that pole piece spring pocket 84*b* may be cylindrical and centered about inlet valve axis 56 and such that a portion of return spring 86 is located within pole piece spring pocket 84*b* in abutment with pole piece spring pocket bottom surface 84*c*.

Armature 85 is made of a material which is attracted by a magnet and is received within inner housing 82 in a slidable relationship to inner housing 82 along inlet valve axis 56 such that armature 85 is centered about, and extends along, inlet valve axis 56. Armature 85 may be of two-piece construction as shown which includes an armature first portion 85*a* which is proximal to pole piece 84 and an armature second portion 85*b* which is fixed to armature first portion 85*a*, for example, by welding or mechanical fasteners and which is distal from pole piece 84. Armature first portion 85*a* includes an armature spring bore 85*c* extending thereinto from an armature first end 85*d* which is proximal to pole piece 84 and which is centered about, and extends along, inlet valve axis 56. A portion of return spring 86 is located within armature spring bore 85*c* and abuts against armature second portion 85*b* such that return spring 86 is held in compression between armature second portion 85*b* and pole piece spring pocket bottom surface 84*c*, thereby biasing armature 85 in a direction away from pole piece 84. Armature second portion 85*b* includes an armature control rod bore 85*e* extending axially therethrough such that armature control rod bore 85*e* is centered about, and extends along, inlet valve axis 56.

Control rod 87 extends from a control rod first end 87*a* which is proximal to armature 85 to a control rod second end 87*b* which is proximal to check valve member 78 such that control rod 87 is centered about, and extends along, inlet valve axis 56. Control rod 87 includes a control rod first shoulder 87*c* which is annular in shape and faces toward armature 85, and as shown, is transverse to inlet valve axis 56. A control rod first surface 87*d* extends from control rod first end 87*a* to control rod first shoulder 87*c* such that control rod first surface 87*d* is located at least partially within armature control rod bore 85*e* in a close sliding interface which allows control rod first surface 87*d* to freely move axially, i.e. along inlet valve axis 56, within armature control rod bore 85*e* while preventing radial movement, i.e. transverse to inlet valve axis 56, of control rod first surface 87*d* within armature control rod bore 85*e*. It is important to note that the close sliding interface between control rod first surface 87*d* and armature control rod bore 85*e* allows control rod 87 to move along inlet valve axis 56 independently of armature 85. Control rod first shoulder 87*c* limits the extent to which control rod first surface 87*d* is inserted into armature control rod bore 85*e* and control rod first shoulder 87*c* also provides a surface for armature 85 to react against in order to move control rod 87 toward check valve member 78 as will be described in greater detail later. Control rod 87 includes a control rod second shoulder 87*e* which is annular in shape and faces toward valve body end wall 60, and as shown, is transverse to inlet valve axis 56. A control rod second surface 87*f* extends from control rod second end 87*b* to control rod second shoulder 87*e* such that control rod second surface 87*f* is located at least partially within valve body central passage 66 in a close sliding interface which allows control rod second surface 87*f* to freely move axially, i.e. along inlet valve axis 56, within valve body central passage 66 while preventing radial movement, i.e. transverse to inlet valve axis 56, of control rod second surface 87*f* within valve body central passage 66. In use, control rod second end 87*b* is used to interface with check valve 52, and more particularly check valve member 78, as will be described in greater detail later.

As illustrated herein, control rod 87 may be of multi-piece construction which includes a control rod central portion 87*g*, a control rod first bushing 87*h* which is tubular and fixed to control rod central portion 87*g*, and a control rod second bushing 87*i* which is tubular and fixed to control rod central portion 87*g*. Control rod central portion 87*g* is preferably cylindrical and is centered about inlet valve axis 56 such that control rod central portion 87*g* extends from control rod first end 87*a* to control rod second end 87*b*. By way of non-limiting example only, control rod central portion 87*g* may be a roller bearing which is commercially available. Control rod first bushing 87*h* is preferably cylindrical on its outer periphery which is centered about, and extends along inlet valve axis 56 such that control rod first shoulder 87*c* is defined by one axial end of control rod first bushing 87*h*. Control rod first bushing 87*h* includes a control rod first bushing bore 87*j* extending axially therethrough such that control rod first bushing bore 87*j* is preferably cylindrical. In order to prevent relative movement between control rod first bushing 87*h* and control rod central portion 87*g*, control rod first bushing 87*h* is fixed to control rod central portion 87*g*, for example, by one or more of interference fit between control rod first bushing bore 87*j* and control rod central portion 87*g* and welding. Similarly, control rod second bushing 87*i* is preferably cylindrical on its outer periphery which is centered about, and extends along, inlet valve axis 56 such that control rod second shoulder 87*e* is defined by one axial end of control rod second bushing 87*i*. Control rod second bushing 87*i* includes a control rod second bushing bore 87*k* extending axially therethrough such that control rod second bushing bore 87*k* is preferably cylindrical. In order to prevent relative movement between control rod second bushing 87*i* and control rod central portion 87*g*, control rod second bushing 87*i* is fixed to control rod central portion 87*g*, for example, by one or more of interference fit between control rod second bushing bore 87*k* and control rod central portion 87*g* and welding. By making control rod 87 a multi-piece component, control rod central portion 87*g* may be provided as a roller bearing which is commercially available in high volumes at low cost with surface finishes and tolerances which are important to the close sliding fit needed between control rod 87 and valve body central passage 66 and between control rod 87 and armature control rod bore 85*e*. In an alternative arrangement, control rod first bushing 87*h* and control rod second bushing 87*i* may be combined to be a single bushing which minimizes the number of components, but has the drawback of increasing mass. In a further alternative, control rod 87 may be formed as a single piece of material in a turning operation.

Spool 88 is made of an electrically insulative material, for example plastic, and is centered about, and extends along, inlet valve axis 56 such that spool 88 circumferentially surrounds inner housing 82 in a close-fitting relationship. Coil 90 is a winding of electrically conductive wire which is wound about the outer periphery of spool 88 such that coil 90 circumferentially surrounds a portion of pole piece 84. Consequently, when coil 90 is energized with an electric current, armature 85 is magnetically attracted to, and moved toward, pole piece 84, and when coil 90 is not energized with an electric current, armature 85 is moved away from pole piece 84 by return spring 86. A more detailed description of operation will be provided later.

Outer housing 94 circumferentially surrounds inner housing 82, spool 88, and coil 90 such that spool 88 and coil 90 are located radially between inner housing 82 and outer housing 94. Overmold 92 is an electrically insulative material, for example plastic, which fills the void between spool 88/coil 90 and outer housing 94 such that overmold 92 extends axially from outer housing 94 to define an electrical connector 96 which includes terminals (not shown) that are connected to opposite ends of coil 90. Electrical connector 96 is configured to mate with a complementary electrical connector (not show) for supplying electric current to coil 90 in use. As shown, a coil washer 98 may be provided within outer housing 94 axially between coil 90 and overmold 92 in order to complete the magnetic circuit of solenoid assembly 54.

Figure 4:
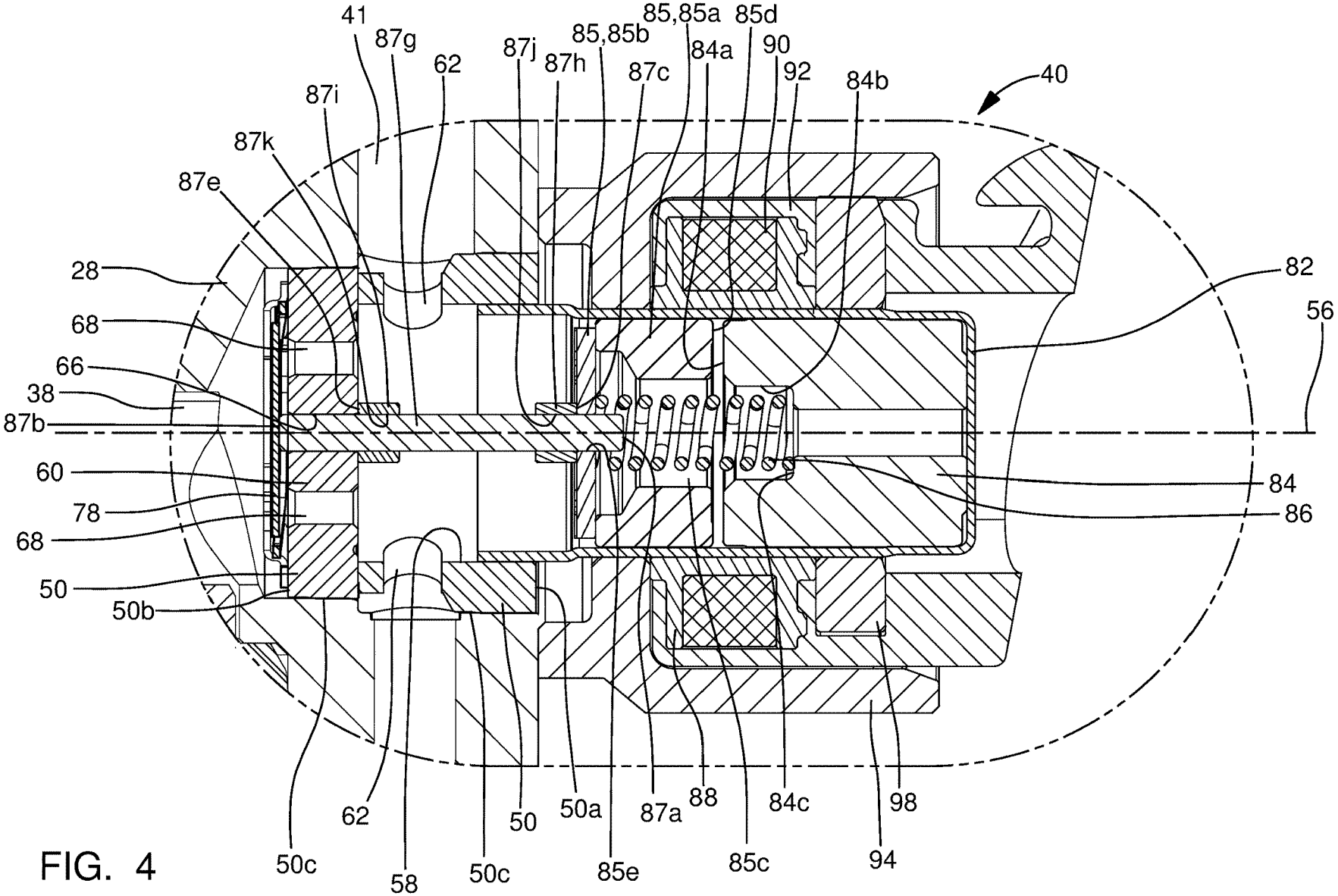
FIG. 4 is an enlargement of a portion of FIG. 2 showing the inlet valve assembly of the fuel pump in a first position.
Figure 6:
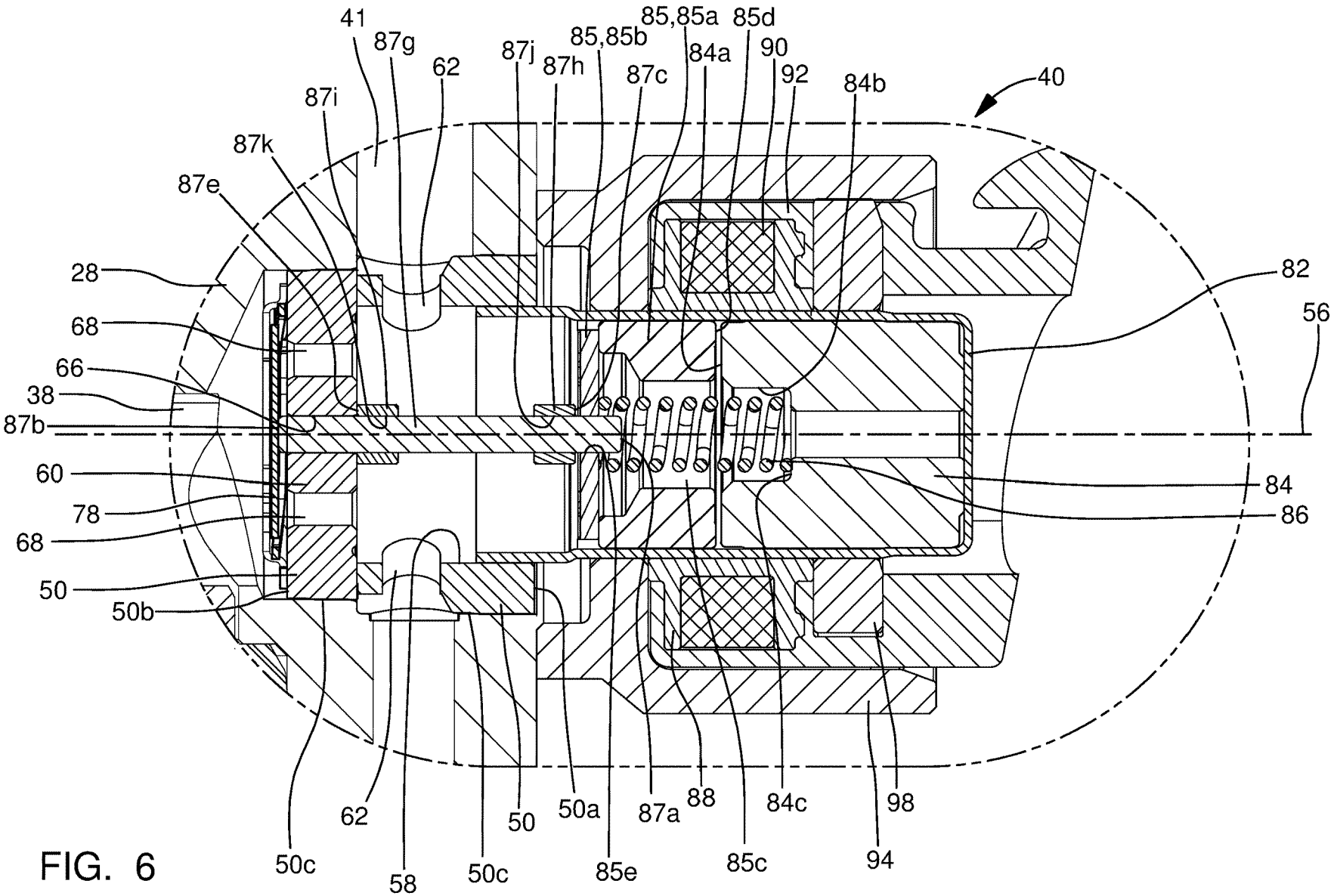
FIG. 6 is the view of FIGS. 4 and 5, now showing the inlet valve assembly in a transient position when moving from the position of FIG. 5 to the position of FIG. 4.

Operation of high-pressure fuel pump 20, and in particular, inlet valve assembly 40, will now be described with particular reference to FIG. 4 which shows armature 85 in a first position which results from no electric current being supplied to coil 90 of solenoid assembly 54. When no electric current is supplied to coil 90, return spring 86 urges armature 85 away from pole piece 84. As armature 85 is urged away from pole piece 84, armature second portion 85*b* comes into contact with control rod first shoulder 87*c* and control rod 87 is urged toward check valve member 78 until control rod second shoulder 87*e* abuts valve body end wall 60 which allows control rod second end 87*b* to protrude beyond valve body second end 50*b* such that control rod second end 87*b* moves check valve member 78 to, and holds check valve member 78 in, an unseated position which permits flow through valve body outlet passages 68 and such that valve body outlet passages 68 are in fluid communication with pumping chamber 38. However, it is important to note that armature 85 may not remain in contact with control rod first shoulder 87*c* for the entire duration of travel, thereby allowing control rod second shoulder 87*e* to abut valve body end wall 60 before armature 85 again comes into contact with control rod first shoulder 87*c*. Consequently, two smaller, individual impacts may result which helps to minimize noise. To illustrate this phenomenon, FIG. 6 shows a transient position where control rod second shoulder 87*e* has impacted valve body end wall 60, however, armature 85 has not yet regained contact with control rod first shoulder 87*c*. Without being bound by theory, this may result from armature 85 impacting control rod first shoulder 87*c* and propelling control rod 87 ahead of armature 85. Holding open check valve member 78 open may be utilized to allow fuel to spill back toward pump housing inlet passage 41 during a portion of the compression stroke of pumping plunger 34 based on the mass of fuel that is needed to be delivered to fuel injectors 16, i.e. different operating conditions of internal combustion engine 12 require different fuel masses to be delivered to fuel injectors 16 for each pumping cycle of pumping plunger 34 and the mass of fuel delivered to fuel injectors 16 can be adjusted by allowing a portion of the fuel involved in a compression stroke to be spilled back to pump housing inlet passage 41. An electronic control unit 100 may be used to time the supply of electric current to coil 90 during the compression stroke, thereby varying the proportion of fuel from the compression stroke that is supplied to fuel injectors 16 and the proportion of fuel from the compression stroke that is spilled back to pump housing inlet passage 41. Electronic control unit 100 may receive input from a pressure sensor 102 which senses the pressure within fuel rail 44 in order to provide proper timing of the supply electric current to coil 90 in order to maintain a desired pressure in fuel rail 44 which may vary based on the commanded torque desired to be produced by internal combustion engine 12.

Figure 5:
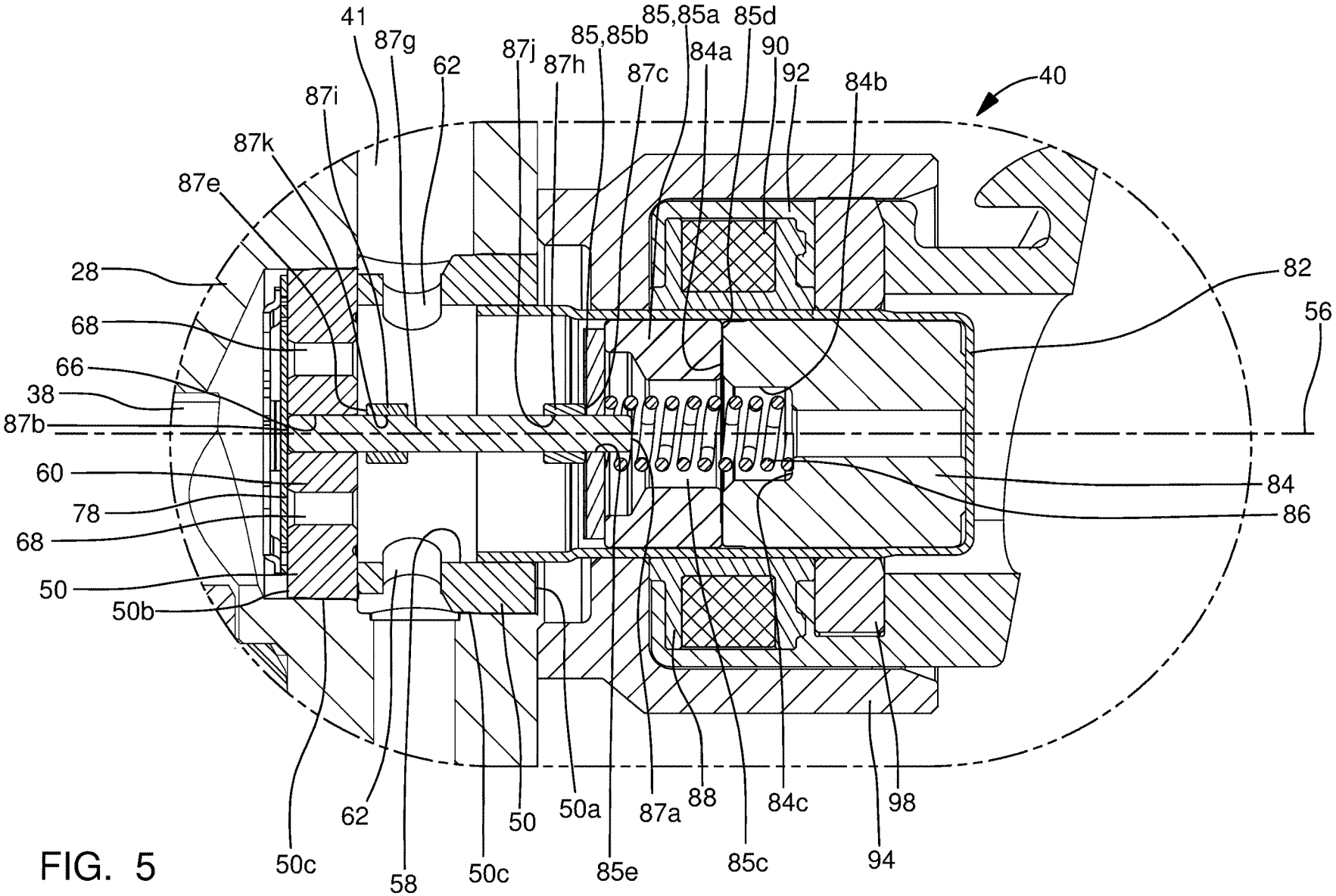
FIG. 5 is the view of FIG. 4, now showing the inlet valve assembly in a second position.

Now with particular reference to FIG. 5, armature 85 is shown in a second position which results from electric current being supplied to coil 90 of solenoid assembly 54. When electric current is supplied to coil 90, armature 85 is attracted to, and moves toward, pole piece 84 until armature first end 85*d* abuts pole piece first end 84*a*. When electric current is supplied to coil 90 during the compression stroke of pumping plunger 34, fuel pressure within pumping chamber 38 acts on check valve member 78, and since armature 85 is no longer acting upon control rod 87, check valve member 78 urges control rod 87 toward armature 85 until check valve member 78 blocks valve body outlet passages 68. It should be noted that since control rod 87 and armature 85 are allowed to move independently of each other along inlet valve axis 56, armature 85 separates from control rod first shoulder 87*c*. As a result, an impact resulting only from the mass of armature 85 coming into abutment with pole piece 84 occurs. Furthermore, since this impact does not include the mass of control rod 87, a smaller sound intensity is produced compared to prior art inlet control valves. It should also be noted that the position of armature 85 illustrated in FIG. 5 does not require check valve member 78 to be in the seated position, but rather, the state of check valve member 78 is determined by the differential pressure across check valve member 78. In this way, check valve member 78 is opened during the intake stroke to allow fuel to flow into pumping chamber 38.

Figure 7:
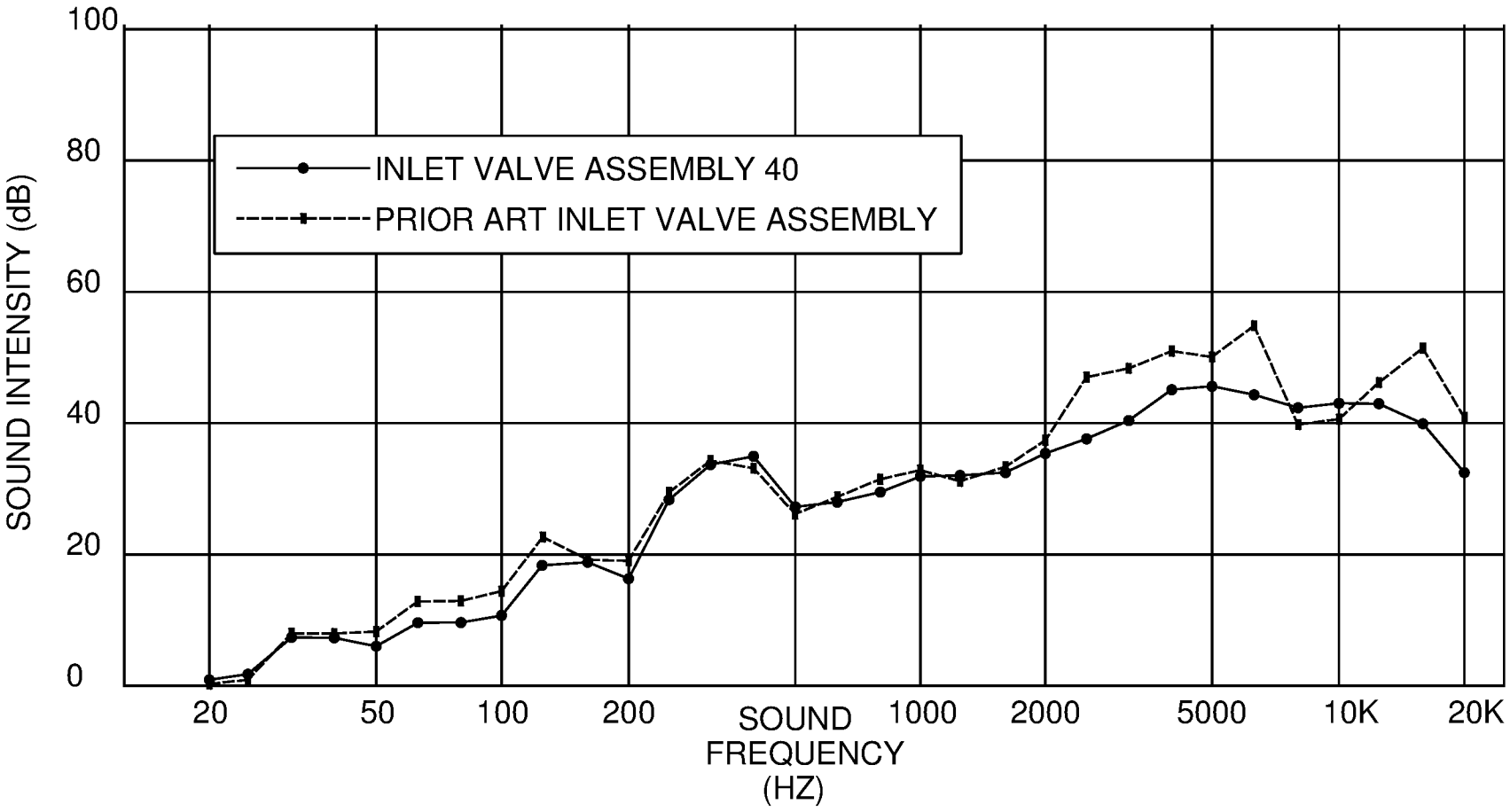
FIG. 7 is a graph showing a plot of sound intensity produced by the inlet valve of the present invention compared to sound intensity produced by a prior art inlet valve.

High-pressure fuel pump 20 with inlet valve assembly 40 as described herein helps to minimize noise associated with operation of inlet valve assembly 40 by allowing armature 85 and control rod 87 to move independently of each other, thereby providing smaller, individual impacts when changing positions from energized to un-energized, i.e. individual impacts resulting from armature 85 and control rod 87 at different times, and also thereby providing a smaller impact when changing positions from un-energized to energized, i.e. impact resulting only from the mass of armature 85. Referring now to FIG. 7, the sound intensity of inlet valve assembly 40 was plotted for sound frequencies from 20 Hz to 20,000 Hz, and similarly, sound intensity for a prior art inlet valve assembly, i.e. the armature and the control rod being rigidly coupled to each other, was plotted for sound frequencies from 20 Hz to 20,000 Hz. The test was conducted for both samples where the internal engine was operated at 750 rotations per minute (RPM) with the inlet valve operated for the high-pressure pump to produce an output of 5 MPa which represents typical operating conditions of an internal combustion engine operating at idle which is when noise produced by the inlet control valve tends to be most noticeable due to other noises being minimized. As can be seen, with only a few exceptions, inlet valve assembly 40 produced lower sound intensities across the frequency range. However, it should be noted that the most notable differences are in the 2,000 Hz-20,000 Hz range which is the range which is most noticeable to the human ear. From the data used to produce FIG. 7, the average sound intensity of inlet valve assembly 40 was 52.9 dB while the average sound intensity for the prior art inlet valve assembly was 59.3 dB, thereby representing a 6.4 dB improvement which is highly desirable.

While this invention has been described in terms of preferred embodiments thereof, it is not intended to be so limited, but rather only to the extent set forth in the claims that follow.

We claim:

1. A fuel pump comprising:

a fuel pump housing with a pumping chamber defined therein;

a pumping plunger which reciprocates within a plunger bore along a plunger bore axis such that an intake stroke of said pumping plunger increases volume of said pumping chamber and a compression stroke of said pumping plunger decreases volume of said pumping chamber; and an inlet valve assembly comprising:

a check valve member which is moveable between 1) an unseated position which provides fluid communication between said pumping chamber and a fuel supply passage and 2) a seated position which prevents fluid communication between said pumping chamber and said fuel supply passage; and a solenoid assembly which includes a wire winding; a pole piece; an armature which is moveable along an inlet valve axis between 1) a first position when said wire winding is not energized with electricity and 2) a second position when said wire winding is energized with electricity; a return spring which biases said armature away from said pole piece; and a control rod which is moveable along said inlet valve axis independently of said armature, wherein said first position of said armature urges said control rod to hold said check valve member in said unseated position and wherein said second position of said armature allows said check valve member to move said control rod to allow said check valve member to move to said seated position.

2. A fuel pump as in claim 1, wherein:

said armature includes an armature control rod bore; and said control rod is received within said armature control rod bore such that said control rod is moveable along said inlet valve axis within said armature control rod bore.

3. A fuel pump as in claim 2, wherein said control rod interfaces with said armature control rod bore in a close sliding interface.

4. A fuel pump as in claim 2, where said control rod includes a control rod shoulder which limits the extent to which said control rod extends into said armature control rod bore.

5. A fuel pump as in claim 4, wherein:

said control rod includes a control rod central portion and a control rod bushing such that said control rod bushing is fixed to said control rod in order to prevent relative movement between said control rod central portion and said control rod bushing;

said control rod bushing includes a control rod bushing bore;

said control rod central portion is received within said control rod bushing bore; and said control rod shoulder is provided on said control rod bushing.

6. A fuel pump as in claim 5, wherein:

said inlet valve assembly further comprises a valve body having a valve body end wall, said valve body end wall with a valve body central passage extending therethrough and a valve body outlet passage extending therethrough, said valve body outlet passage being blocked by said check valve member when said check valve member is in said seated position and said valve body outlet passage being unblocked by said check valve member when said check valve member is in said unseated position which allows fluid communication through said valve body outlet passage between said pumping chamber and said fuel supply passage; and said control rod interfaces with said valve body central passage in a close sliding interface.

7. A fuel pump as in claim 6, where:

said control rod shoulder is a first control rod shoulder; and said control rod includes a control rod second shoulder which limits the extent to which said control rod extends into said valve body central passage.

8. A fuel pump as in claim 7, wherein:

said control rod bushing is a first control rod bushing;

said control rod bushing bore is a first control rod bushing bore;

said control rod includes a control rod second bushing such that said control rod second bushing is fixed to said control rod in order to prevent relative movement between said control rod central portion and said control rod bushing;

said control rod second bushing includes a control rod second bushing bore;

said control rod central portion is received within said control rod second bushing bore; and said control rod second shoulder is provided on said control rod second bushing.

9. A fuel pump as in claim 1, wherein:

said inlet valve assembly further comprises a valve body having a valve body end wall, said valve body end wall with a valve body central passage extending therethrough and a valve body outlet passage extending therethrough, said valve body outlet passage being blocked by said check valve member when said check valve member is in said seated position and said valve body outlet passage being unblocked by said check valve member when said check valve member is in said unseated position which allows fluid communication through said valve body outlet passage between said pumping chamber and said fuel supply passage; and said control rod interfaces with said valve body central passage in a close sliding interface.

10. A fuel pump as in claim 9, where said control rod includes a control rod shoulder which limits the extent to which said control rod extends into said valve body central passage.

11. A fuel pump as in claim 10, wherein:

said control rod includes a control rod central portion and a control rod bushing such that said control rod bushing is fixed to said control rod in order to prevent relative movement between said control rod central portion and said control rod bushing;

said control rod bushing includes a control rod bushing bore;

said control rod central portion is received within said control rod bushing bore; and said control rod shoulder is provided on said control rod bushing.

12. An inlet valve assembly for a fuel pump having a fuel pump housing with a pumping chamber defined therein; a pumping plunger which reciprocates within a plunger bore along a plunger bore axis such that an intake stroke of said pumping plunger increases volume of said pumping chamber and a compression stroke of said pumping plunger decreases volume of said pumping chamber, said inlet valve assembly comprising:

a check valve member which is moveable between 1) an unseated position which provides fluid communication through said inlet valve assembly and 2) a seated position which prevents fluid communication through said inlet valve assembly; and a solenoid assembly which includes a wire winding; a pole piece; an armature which is moveable along an inlet valve axis between 1) a first position when said wire winding is not energized with electricity and 2) a second position when said wire winding is energized with electricity; a return spring which biases said armature away from said pole piece; and a control rod which is moveable along said inlet valve axis independently of said armature, wherein said first position of said armature urges said control rod to hold said check valve member in said unseated position and wherein said second position of said armature allows said check valve member to move said control rod to allow said check valve member to move to said seated position.

13. An inlet valve assembly as in claim 12, wherein:

said armature includes an armature control rod bore; and said control rod is received within said armature control rod bore such that said control rod is moveable along said inlet valve axis within said armature control rod bore.

14. An inlet valve assembly as in claim 13, wherein said control rod interfaces with said armature control rod bore in a close sliding interface.

15. An inlet valve assembly as in claim 13, where said control rod includes a control rod shoulder which limits the extent to which said control rod extends into said armature control rod bore.

16. An inlet valve assembly as in claim 15, wherein:

said control rod includes a control rod central portion and a control rod bushing such that said control rod bushing is fixed to said control rod in order to prevent relative movement between said control rod central portion and said control rod bushing;

said control rod bushing includes a control rod bushing bore;

said control rod central portion is received within said control rod bushing bore; and said control rod shoulder is provided on said control rod bushing.

17. An inlet valve assembly as in claim 16, wherein:

said inlet valve assembly further comprises a valve body having a valve body end wall, said valve body end wall with a valve body central passage extending therethrough and a valve body outlet passage extending therethrough, said valve body outlet passage being blocked by said check valve member when said check valve member is in said seated position and said valve body outlet passage being unblocked by said check valve member when said check valve member is in said unseated position which allows fluid communication through said valve body outlet passage between said pumping chamber and a fuel supply passage; and said control rod interfaces with said valve body central passage in a close sliding interface.

18. An inlet valve assembly as in claim 17, where:

said control rod shoulder is a first control rod shoulder; and said control rod includes a control rod second shoulder which limits the extent to which said control rod extends into said valve body central passage.

19. An inlet valve assembly as in claim 18, wherein:

said control rod bushing is a first control rod bushing;

said control rod bushing bore is a first control rod bushing bore;

said control rod includes a control rod second bushing such that said control rod second bushing is fixed to said control rod in order to prevent relative movement between said control rod central portion and said control rod bushing;

said control rod second bushing includes a control rod second bushing bore;

said control rod central portion is received within said control rod second bushing bore; and said control rod second shoulder is provided on said control rod second bushing.

* * * * *